US005527657A

United States Patent [19]

Takeda et al.

[11] Patent Number: 5,527,657

[45] Date of Patent: Jun. 18, 1996

[54] ONE-COMPONENT MAGNETIC TONER FOR USE IN ELECTROPHOTOGRAPHY

[75] Inventors: Fuchio Takeda, Tokyo; Hachiro Tosaka, Shizuoka-ken; Kunihiko Tomita, Hadano, all of Japan

[73] Assignee: Ricoh Company, Ltd., Tokyo, Japan

[21] Appl. No.: 343,188

[22] Filed: Nov. 22, 1994

[30] Foreign Application Priority Data

Nov. 22, 1993 [JP] Japan ..... 5-315950

[51] Int. Cl.[6] ..... G03G 9/083

[52] U.S. Cl. ..... 430/106.6; 430/903

[58] Field of Search ..... 430/106.6, 903

[56] References Cited

U.S. PATENT DOCUMENTS 3,627,682 12/1971 Hall et al. ..... 430/106.6

4,946,755 8/1990 Inoue ..... 430/903

*Primary Examiner*—John Goodrow

*Attorney, Agent, or Firm*—Cooper & Dunham

[57] ABSTRACT

A one-component magnetic toner with high resistivity for use in electrophotography for developing latent electrostatic images to visible toner images by contact development, includes a coloring agent, a binder resin, and a magnetic material which contains a bivalent metal and a trivalent iron with the molar ratio of the bivalent metal to the trivalent iron being ⅓ or less.

3 Claims, 4 Drawing Sheets

ONE-COMPONENT MAGNETIC TONER FOR USE IN ELECTROPHOTOGRAPHY

BACKGROUND OF THE INVENTION

1. Field of the Invention

The present invention relates to a one-component magnetic toner with high resistivity for use in electrophotography for developing latent electrostatic images to visible toner images by contact development.

2. Discussion of Background

Two-component or one-component dry developers are in general use for the contact development in electrophotography. Although the one- and two-component developers have their own merits and drawbacks, one-component developers are advantageous over two-component developers because the composition thereof does not substantially change while in use for an extended period of time. In addition, one-component magnetic toners are widely used because they can be employed in both contact development and non-contact development, and can be satisfactorily deposited on a development roller and transferred therefrom to latent electrostatic images formed on a latent-electrostatic-image bearing member for the development thereof.

For example, there is disclosed a one-component magnetic toner with high resistivity for use as a non-contact developer in Japanese Laid-Open Patent Application 58-189646. This one-component magnetic toner comprises a magnetic material containing FeO in an amount of 16 to 25 wt. %. In this one-component magnetic toner, the amount of FeO is limited to the above-mentioned amount in view of the image transfer performance of the toner and the color tone of the obtained images. In this Japanese Laid-Open Patent Application, it is asserted that the fluidity of FeO is good and accordingly the dispersibility of FeO in the toner is also good, so that the image transfer performance of the toner and the color tone of obtained images can be improved.

However, it is considered that there are some difficulties in employing the above-mentioned one-component magnetic toner as it is for contact development. The reasons for this are as follows: (1) Japanese Laid-Open Patent Application 58-189646 asserts that the one-component magnetic toner disclosed therein is suitable for non-contact development, but does not mention anything about the application of the toner to contact development method. (2) The inventors of the present invention have discovered that not all one-component magnetic toners comprising an iron-based magnetic material are suitable for contact development, and the suitability thereof depends upon the structure or composition of the iron-based magnetic material employed therein.

SUMMARY OF THE INVENTION

Accordingly, an object of the present invention is to provide a one-component magnetic toner for use in electrophotography for developing latent electrostatic images to visible toner images, particularly suitable for contact development.

The above-mentioned object of the present invention can be achieved by a one-component magnetic toner with high resistivity, comprising a coloring agent, a binder resin, and a magnetic material which comprises a bivalent metal and a trivalent iron with the molar ratio of the bivalent metal to the trivalent iron being ⅓ or less.

When the bivalent metal for use in the above magnetic material in a bivalent iron, it is preferable that the molar ratio of the bivalent iron to the trivalent iron be ¼ or less.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

The contact development to which the one-component magnetic toner according to the present invention is applicable will now be described in detail.

In the contact development, a thin layer of the one-component magnetic toner is formed on a development roller comprising a dielectric layer in which multipole-magnetized materials are dispersed. In the contact development, it is preferable that the toner layer have a thickness corresponding to the height of two toner particles overlaid vertically. The than toner layer thus formed on the development roller is brought into contact with latent electrostatic images formed on a latent-electrostatic-image bearing member such as a photoconductor to develop the latent electrostatic images into visible toner images. Such a contact development method has the advantages over other development methods that the toner deposition on the background of images can be prevented, a sufficient saturation amount of toner can be supplied to latent electrostatic images to be developed, and the resolution of the obtained images is excellent, in particular, with respect to thin line images and single dots.

However, when the difference between (a) a background potential, for instance, on the surface of a latent-electrostatic-image bearing photoconductor and (b) a bias voltage applied to the latent-electrostatic-image bearing photoconductor is extremely large, the charging polarity of toner particles which are present in the electric field formed by the background potential and the bias voltage is reversed, so that an excessively large amount of the toner particles is deposited on the photoconductor. This phenomenon is called reverse bias development.

Figure 5:
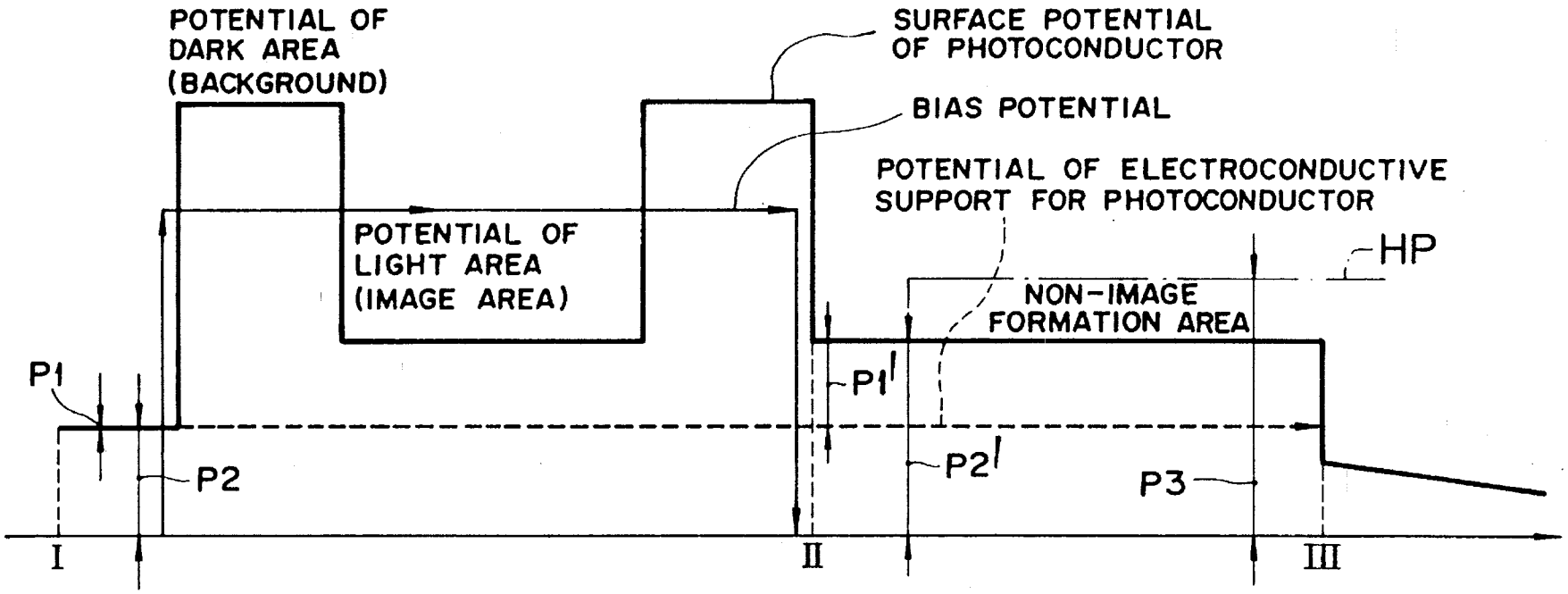
FIG. 5 is a diagram showing the changes in the surface potential of a photoconductor surface, a bias potential of a voltage applied thereto, and the potential of an electroconductive support for the photoconductor, measured from the position where the photoconductor is in contact with a development roller.

In an image formation apparatus which performs reversal development, when the potential of a light-exposed portion of the photoconductor is close to 0 V, normal development is carried out at the start of an image formation procedure indicated by I in FIG. 5, and in a region from the completion of a final image formation indicated by II in FIG. 5 through the termination of the image formation procedure indicated by III in FIG. 5, even when the bias potential is set at zero volt. As shown in FIG. 5, in order to avoid the normal development and minimize the consumption of the toner, a bias voltage is applied to an electroconductive support for the photoconductor so as to maintain the apparent charged potential of the photoconductor.

In FIG. 5, P1 is the potential difference between the bias potential and the potential of the electroconductive support for the photoconductor at the start of the image formation as indicated by I, which potential difference is substantially zero; P1' is the potential difference between the bias potential and the potential of the electroconductive support for the photoconductor at the completion of the image formation as indicated by II; P2 is the potential difference between the bias potential and the potential of the electroconductive support for the photoconductor at the start of the image formation as indicated by I, when a bias voltage is applied to the electroconductive support for the photoconductor; P2' is the potential difference between the bias potential and the potential of the electroconductive support for the photoconductor at the completion of the image formation as indicated by II when the above-mentioned bias voltage is applied to the electroconductive support for the photoconductor; and P3 is the potential difference between the bias potential and the potential of the electroconductive support for the photoconductor at the completion of the image formation as indicated by II when the surface potential in a light area of the photoconductor is a high level as indicated by the alternate long and short dash line HP.

Although the bias voltage is applied to the electroconductive support for the photoconductor so as to maintain the apparent charged potential of the photoconductor as mentioned previously, the sensitivity of the photoconductor varies depending on the manufacturing conditions thereof, so that when the surface potential of the photoconductor measured from the electroconductive support side is not decreased to a level below a predetermined value as indicated by the alternate long and short dash line HP, the value of the reverse bias potential difference is increased, so that the reverse bias development is induced. As a result, the toner is wasted, and the lives of the toner and a cleaning unit are considerably reduced. In addition, the toner particles are scattered from the surface of the photoconductor, so that not only the inside of a copying apparatus, but also the back sides of image-receiving sheets are stained with the toner particles. Furthermore, the malfunction of an optical system for the copying machine is also caused by the scattering of the toner particles.

The one-component magnetic toner according to the present invention is capable of preventing the occurrence of the above-mentioned problems caused by conventional one-component magnetic toners when used in the contact development and achieving image formation under remarkably stable conditions.

Although the normal development obtained by the one-component magnetic toner of the present invention is almost the same as that obtained by conventional one-component magnetic toners, the development performance with respect to reverse bias development can be drastically improved by the one-component magnetic toner of the present invention.

Figure 1:
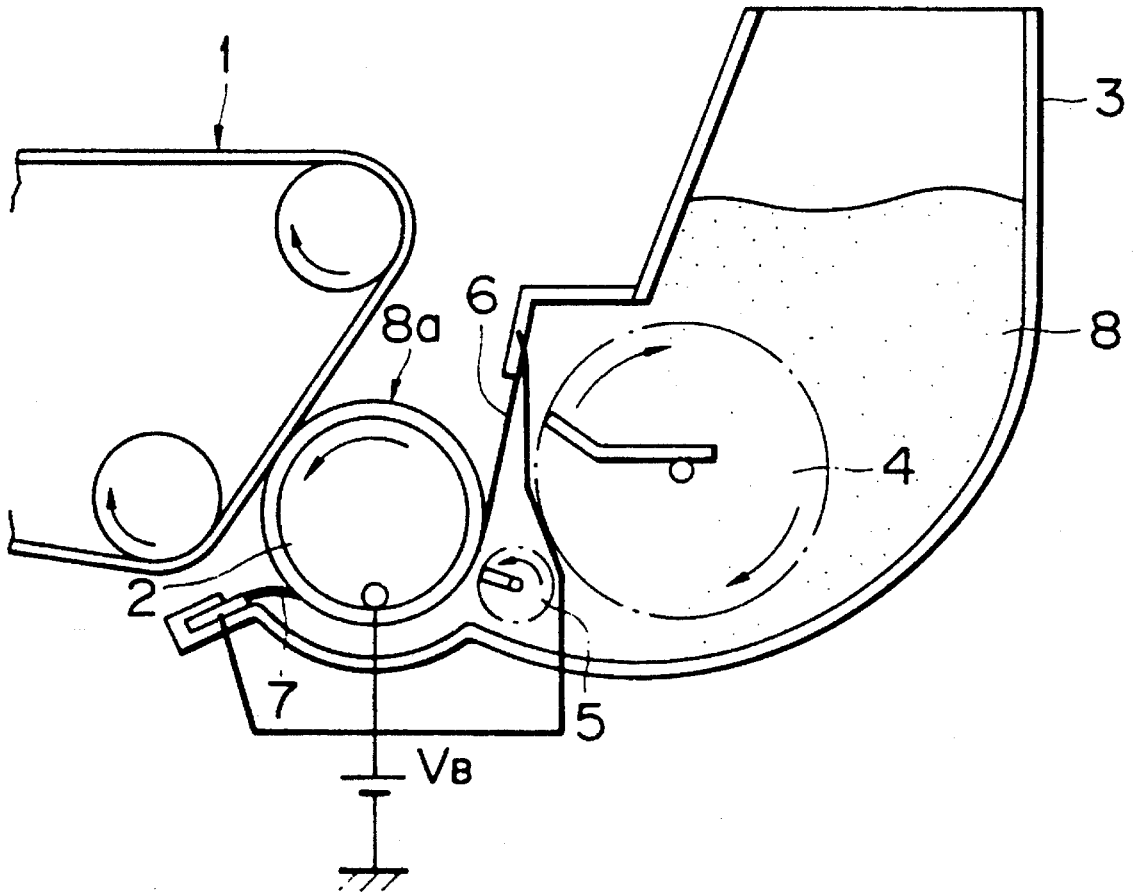
FIG. 1 is a schematic diagram showing a developer unit for contact development for a one-component magnetic toner of the present invention.

FIG. 1 is a schematic diagram of a development unit contact development method, using the one-component magnetic toner of the present invention. In FIG. 1, reference numeral 1 indicates a photoconductor; reference numeral 2, a development roller; reference numeral 3, a toner hopper; reference numeral 4, an agitator for stirring toner 8; reference numeral 5, a paddle for replenishment of the toner 8; reference numeral 6, a blade for fuming a thin layer 8*a* of the toner 8; and reference numeral 7, a quenching brush.

In the contact development as shown in FIG. 1, the toner thin layer 8*a* formed on the development roller 2 is always in contact with latent electrostatic images formed on the surface of the photoconductor 1. Therefore, when the polarity of the toner 8 is reversed, such reversibly charged toner is deposited on the background areas of the photoconductor 1, and also of non-image formation areas before and after the image formation process.

Figure 2:
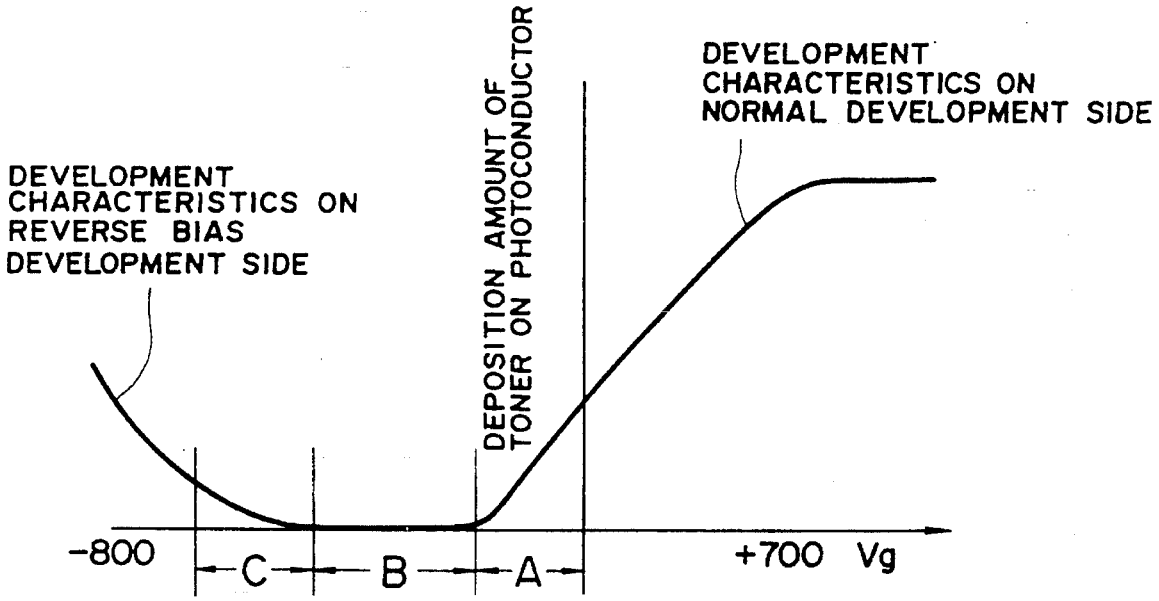
FIG. 2 is a graph in explanation of the relationship between a development potential difference (Vg), which is obtained by subtracting a bias potential ($V_B$) from the surface potential ($V_S$) of a photoconductor, and the amount of the toner deposited on the photoconductor.

FIG. 2 is a graph showing the relationship between a development potential difference (Vg), which is obtained by subtracting a bias potential ($V_8$) from the surface potential ($V_S$) of the photoconductor, and the amount of toner particles deposited on the photoconductor 1. As shown in FIG. 2, a curve ascending from left to right indicates the increase In the amount of residual toner in the normal development.

In the graph shown in FIG. 2, toner particles with the normal polarity are deposited in such a manner that the amount of the deposited toner particles is increased along the curve ascending from left to right on the normal development side, while toner particles with the reversed polarity are deposited is such a manner that the amount of the deposited toner particles is increased along the curve descending from right to left.

In FIG. 2, area A corresponds to the area corresponding to the potential difference P1 or P1' in FIG. 5; area B corresponds to the potential difference P2 or P2' in FIG. 5; and area C corresponds to the potential difference P3 in FIG. 5.

The inventors of the present invention have further investigated the amount of the toner that remains on the photoconductor after image transfer and can be recovered by a cleaning unit in the reverse bias development by using one-component magnetic toners comprising a different iron-containing magnetic material. As a result, it was found that the total amount of the toner that can be recovered by the cleaning unit varied depending on the molar ratio of a bivalent metal to the trivalent iron in the magnetite contained in the toners.

Figure 3:
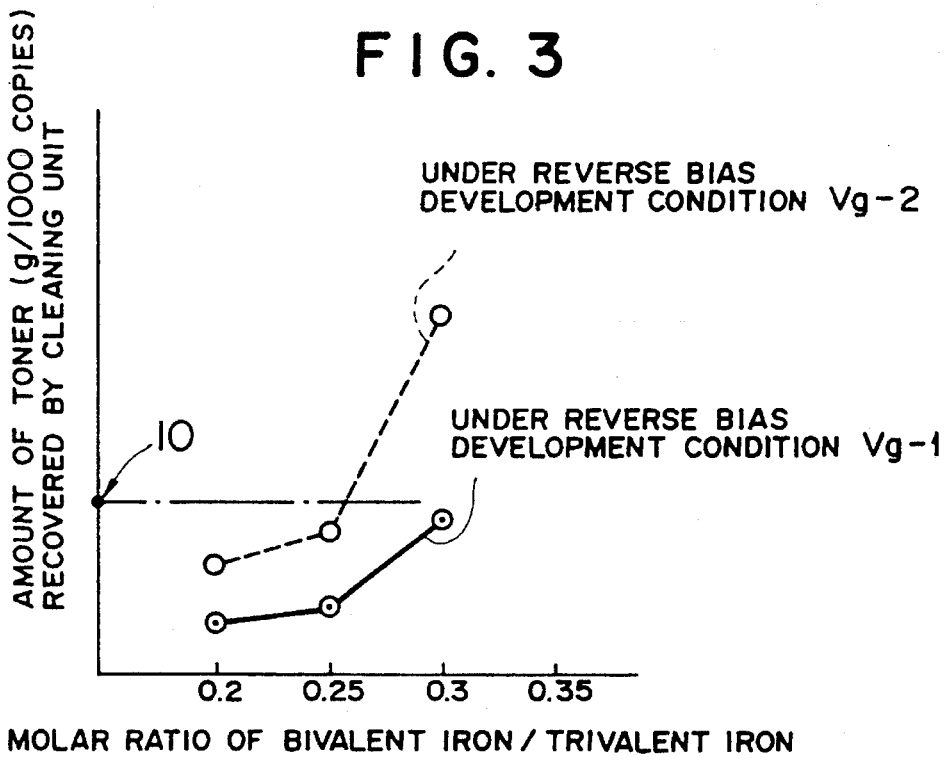
FIG. 3 is a graph in explanation of the relationship between the molar ratio of bivalent iron to trivalent iron with two valences to iron with three valences in an iron-based magnetic material for use in one-component magnetic toners, and the amount of the toner recovered by a cleaning unit.

When the molar ratio of the bivalent metal to the trivalent iron in the magnetic material for use in the one-component magnetic toner is ⅓ or less, the total amount of the recovered toner can be reduced. In the case where the bivalent metal is a bivalent iron, it is preferable that the molar ratio of the bivalent iron to the trivalent iron be ¼ or less to decrease the amount of the toner remaining on the photoconductor after image transfer and accordingly to reduce the amount of the toner to be recovered after the image transfer as shown in FIG. 3. In addition, when zinc or manganese was employed as the bivalent metal, the similar results were obtained.

In the above, the molar ratio of the bivalent iron to the trivalent iron can be determined by conventional analytical methods or by the methods described in Japanese Industrial Standards (JIS) M8213 and K1462.

More specifically, FIG. 3 shows a graph, with the molar ratio of bivalent iron to trivalent iron in a magnetic material contained in the one-component magnetic toner as abscissa, and the amount of the toner recovered from the photoconductor by a cleaning unit after image transfer with a unit of g/1000 copies as ordinate.

In FIG. 3, the broken line indicates the changes in the amount of the toner recovered when the reverse bias development was carried out under the conditions that the development potential difference (Vg) was varied in a range of −200 V to −600 V.

Furthermore, in FIG. 3, The solid line indicates the changes in the amount of the toner recovered when the development potential difference (Vg) was varied in a range of −100 to −500 V. An alternate long and short dash line shown in FIG. 3 indicates a level of a recovered toner amount of 10 g/1000 copies.

Figure 4:
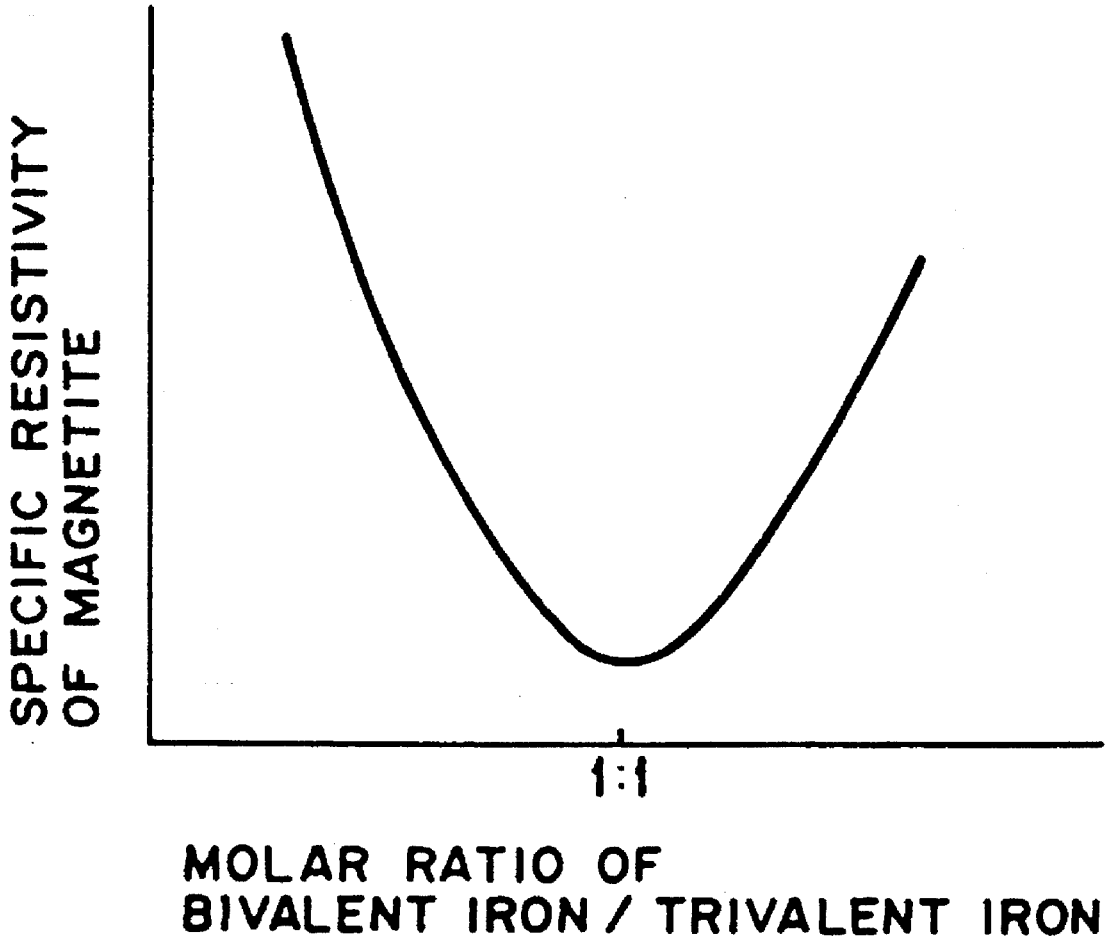
FIG. 4 is a graph in explanation of the relationship between the molar ratio of bivalent iron to trivalent iron in an iron-based magnetic material (magnetite) for use in a one-component magnetic toner, and the specific resistivity of the iron-based magnetic material.

Specific examples of the magnetic material for use in the one-component magnetic toner of the present invention are magnetite and ferrite. The electroconductivity of such a magnetic material is largely influenced by the mutual exchange interaction between the bivalent metal and the trivalent iron through the intermediation of an oxygen atom or oxygen atoms. When the bivalent metal and the trivalent iron are present in the magnetic material in an equimolar amount, the electroconductivity of the magnetic material becomes maximum and can be reduced by decreasing the amount of the bivalent metal as shown in FIG. 4.

It is advantageous that the molar ratio of the bivalent metal to the trivalent iron be controlled to ⅓ or less in the iron-containing magnetic material dispersed in the one-component toner.

Iron-based magnetic materials comprising a bivalent metal for use in the one-component magnetic toner have large electroconductivity, and are apt to be subjected to the charge injection from the external electric field. Experiments conducted by the inventors of the present invention that the amount of the bivalent metal which is easily affected by the charge injection has much larger effects on the occurrence of the reversible bias development and also on the deposition amount of toner and the allowance for the occurrence of the reverse bias development in the course of the reverse bias development than the volume resistivity of the toner. Therefore by adjusting the amount of the bivalent metal in the magnetic material for use in the one-component magnetic toner of the present invention as mentioned previously, the amount of the toner recovered by the cleaning unit after toner image transfer can be significantly reduced.

The one-component magnetic toner according to the present invention can be prepared by the conventional method.

Any binder resins for use in the conventional toner can be used in the magnetic toner of the present invention. Examples of the binder resin for use in the magnetic toner of the present invention include styrene and homopolymers of styrene and substituted styrene such as polystyrene, polychlorostyrene and polyvinyl toluene; styrene copolymers such as styrene - p-chlorostyrene copolymer, styrene - propylene copolymer, styrene vinyltoluene copolymer, styrene - vinylnaphthalene copolymer, styrene - methyl acrylate copolymer, styrene - ethyl acrylate copolymer, styrene - butyl acrylate copolymer, styrene - octyl acrylate copolymer, styrene - methyl methacrylate copolymer, styrene - ethyl methacrylate copolymer, styrene - butyl methacrylate copolymer, styrene - α-chloromethyl methacrylate copolymer, styrene - acrylonitrile copolymer, styrene vinylmethyl ether copolymer, styrene - vinylmethyl ketone copolymer, styrene - butadiene copolymer, styrene isoprene copolymer, styrene - acrylonitrile - indene copolymer, styrene - maleic acid copolymer, and styrene - maleate copolymer; polymethyl methacrylate, polybutyl methacrylate, polyvinyl chloride, polyvinyl acetate, polyethylene, polypropylene, polyester, polyvinyl butyral, polyacrylic resin, rosin, modified rosin, terpene resin, and phenolic resin.

Any conventional pigments and dyes are usable as the coloring agents for use in the magnetic toner of the present invention.

Examples of the coloring agent for use in the present invention are ultramarine blue, nigrosine dyes, Aniline Blue, Calconyl Blue, Du Pont Oil Red, Quinoline Yellow, Methylene Blue Chloride, Phthalocyanine Blue, Phthalocyanine Green, Rhodamine 6C Lake, quinacridone, Benzidine Yellow, Malachite Green, Mansa Yellow G, Malachite Green Mexarate, Oil Black, Azo Oil Black, Rose Bengale, monoazo dyes and pigments, disazo dyes and pigments, and trisazo dyes and pigments.

Any charge controlling agent for use in the conventional magnetic toners can be used in the one-component magnetic toner of the present invention. For example, nigrosine, quaternary ammonium salts, metal-containing azo dyes and complex compounds of salicylic acid can be employed as the charge controlling agents.

Other features of this invention will become apparent in the course of the following description of exemplary embodiments, which are given for illustration of the invention and are not intended to be limiting thereof.

Example 1

The following components were thoroughly mixed and stirred in a Henschel mixer:

| | Parts by Weight |
|---|---|
| Spherical magnetite with a number-average particle size of 0.13 μm containing the molar ratio of bivalent iron to trivalent iron being 0.2 | 100 |
| Styrene - n-butyl methacrylate copolymer | 100 |
| Low-molecular-weight polypropylene | 4 |
| Charge controlling agent (Trademark "E-84", made by Orient Chemical Industries, Ltd. | 2 |

The above obtained mixture was kneaded at 130°–140° C. for 30 minutes in a roll mill, and then cooled to room temperature. The thus obtained kneaded mixture was pulverized and classified, so that toner particles with a particle diameter of 5–10 μm were obtained.

100 parts by weight of the above prepared toner particles and 0.2 parts by weight of colloidal silica were mixed, whereby a one-component magnetic toner No. 1 according to the present invention was obtained.

The thus obtained one-component magnetic toner No. 1 according to the present invention was subjected to an image formation test using a commercially available copying machine (Trademark "IMAGIO MF-150", made by Ricoh Company, Ltd.). Images obtained by the above test were clear.

Under the condition that the development potential difference (Vg) was in a range of −100 to −500 V, which is referred to as reverse bias development condition Vg-1 as shown in FIG. 3, the amount of the toner particles recovered by a cleaning unit was 2.5 g.

Under the condition that the development potential difference (Vg) was in a range of −200 to −600 V, which is referred to as reverse bias development condition Vg-2 as shown in FIG. 3, the amount of the toner particles recovered by the cleaning unit was 6.0 g.

Even after the making of 30,000 copies, the obtained images were still clear.

Example 2

The following components were thoroughly mixed and stirred in a Henschel mixers:

| | Parts by Weight |
|---|---|
| Hexahedral magnetite with a number-average particle size of 0.19 μm containing the molar ratio of bivalent iron to trivalent iron being being 0.25 | 80 |
| Styrene - n-butyl methacrylate copolymer | 100 |
| Low-molecular-weight polypropylene | 6 |
| Charge controlling agent (Trademark "E-84", made by Orient Chemical Industries, Ltd. | 4 |

The above obtained mixture was kneaded at 130°–140° C. for 30 minutes in a roll mill, and then cooled to room temperature. The thus obtained kneaded mixture was pulverized and classified, so that toner particles with a particle diameter of 5–13 μm were obtained.

100 parts by weight of the above prepared toner particles and 0.4 parts by weight of colloidal silica were mixed, whereby a one-component magnetic toner No. 2 according to the present invention was obtained.

The thus obtained one-component magnetic toner No. 2 according to the present invention was subjected to the same image formation test as in Example 1 by using the same copying machine as used in Example 1. Images obtained by the above test were clear.

Under the reverse bias development condition Vg-1 as shown in FIG. 3, the amount of the toner particles recovered by the cleaning unit was 3.0 g.

Under the reverse bias development condition Vg-2 as shown in FIG. 3, the amount of the toner particles recovered by the cleaning unit was 8.0 g.

Even after the making of 50,000 copies, no toner deposition on the background areas on the photoconductor was observed, and the obtained images were still clear.

Example 3

The following components were thoroughly mixed and stirred in a Henschel mixer:

| | Parts by Weight |
|---|---|
| Octahedral magnetite with a number-average particle size of 0.16 μm with the molar ratio of bivalent iron trivalent iron being 0.3 | 40 |
| Styrene - n-butyl methacrylate copolymer | 100 |

-continued

| | Parts by Weight |
|---|---|
| Low-molecular-weight polypropylene | 5 |
| Charge controlling agent (Trademark "S-84", made by Orient Chemical Industries, Ltd. | 3 |

The above obtained mixture was kneaded at 130°–140° C. for 30 minutes in a roll mill, and then cooled to room temperature. The thus obtained kneaded mixture was pulverized and classified, so that toner particles with a particle diameter of 5–13 μm were obtained.

100 parts by weight of the above prepared toner particles and 0.5 parts by weight of colloidal silica were mixed, whereby a one-component magnetic toner No. 3 according to the present invention was obtained.

The thus obtained one-component magnetic toner No. 3 according to the present invention was subjected to the same image formation test as in Example 1 by using the same copying machine as used in Example 1. Images obtained by the above test were clear.

Under the reverse bias development condition Vg-1 as shown in FIG. 3, the amount of the toner particles recovered by the cleaning unit was 9.5 g.

Under the reverse bias development condition Vg-2 as shown in FIG. 3, the amount of the toner particles recovered by the cleaning unit was 22 g.

Even after the making of 50,000 copies under the reverse bias development condition Vg-1, the obtained images were still clear.

However, under the reverse bias development condition Vg-2, images obtained after the making of 50,000 copies were not clear because the toner was deposited on the background of the images under the conditions the ambient temperature was as low as 10° C. and the humidity was as low as 15% RH.

Comparative Example 1

The following components were thoroughly mixed and stirred in a Henschel mixer:

| | Parts by Weight |
|---|---|
| Spherical magnetite with a number-average particle size of 0.30 μm with the molar ratio of bivalent iron trivalent iron being 0.4 | 90 |
| Styrene - n-butyl methacrylate copolymer | 100 |
| Low-molecular-weight polypropylene | 4 |
| Charge controlling agent (Trademark "E-84", made by Orient Chemical Industries, Ltd. | 4 |

The above obtained mixture was kneaded at 130°–140° C. for 30 minutes in a roll mill, and then cooled to room temperature. The thus obtained kneaded mixture was pulverized and classified, so that toner particles with a particle diameter of 5–13 μm were obtained.

100 parts by weight of the above prepared toner particles and 0.4 parts by weight of colloidal silica were mixed, whereby a comparative one-component magnetic toner No. 1 was obtained.

The thus obtained comparative one-component magnetic toner No. 1 was subjected to the same image formation test as in Example 1 by using the same copying machine as used in Example 1. The toner was considerably deposited on the background areas of the photoconductor, and the toner was also deposited on the background of the images obtained by the above test.

Even the reverse bias development condition Vg-1 as shown in FIG. 3, the amount of the toner particles recovered by the cleaning unit was as excessively large as 40 g.

Japanese Patent Application No. 5-315950 filed on Nov. 22, 1993 is hereby incorporated by reference.

What is claimed is:

1. A one-component magnetic toner with high resistivity for use in electrophotography for developing latent electrostatic images to visible toner images by contact development, said toner including a coloring agent and comprising a binder resin and a magnetic material which comprises a bivalent metal and a trivalent iron with the molar ratio of said bivalent metal to said trivalent iron being ⅓ or less.

2. The one-component magnetic toner as claimed in claim 1, wherein said bivalent metal is a bivalent iron, and the molar ratio of said bivalent iron to said trivalent iron is ¼ or less.

3. The one-component magnetic toner as claimed in claim 1, further comprising a charge controlling agent.

* * * * *